US009038506B1

(12) United States Patent
Huang et al.

(10) Patent No.: US 9,038,506 B1
(45) Date of Patent: May 26, 2015

(54) SOCKET WRENCH WITH POSITIONING DEVICE

(71) Applicants: Miao-Chi Huang, Taichung (TW); Jen-Kai Li, Taichung (TW)

(72) Inventors: Miao-Chi Huang, Taichung (TW); Jen-Kai Li, Taichung (TW)

( * ) Notice: Subject to any disclaimer, the term of this patent is extended or adjusted under 35 U.S.C. 154(b) by 0 days.

(21) Appl. No.: 14/459,797

(22) Filed: Aug. 14, 2014

(51) Int. Cl.

| | |
|---|---|
| ***B25B 13/46*** | (2006.01) |
| ***B25B 23/00*** | (2006.01) |
| ***B25B 13/06*** | (2006.01) |
| *B25G 1/06* | (2006.01) |

(52) U.S. Cl.
CPC ..... *B25B 23/0035* (2013.01); *B25B 13/463* (2013.01); *B25B 13/06* (2013.01); *B25B 13/462* (2013.01); *B25B 13/461* (2013.01); *B25G 1/063* (2013.01)

(58) Field of Classification Search
CPC B25B 13/463; B25B 13/461; B25B 23/0035; B25B 13/462; B25G 1/063
USPC ..... 81/60–63.2
See application file for complete search history.

(56) References Cited

U.S. PATENT DOCUMENTS

| | | | | |
|---|---|---|---|---|
| 4,328,720 | A * | 5/1982 | Shiel | 81/63 |
| 4,491,043 | A * | 1/1985 | Dempsey et al. | 81/58 |
| 4,762,033 | A * | 8/1988 | Chow | 81/63.2 |
| 6,257,096 | B1 * | 7/2001 | Ling | 81/60 |
| 6,305,247 | B1 * | 10/2001 | Chen | 81/60 |
| 6,467,378 | B1 * | 10/2002 | Chen | 81/60 |
| 6,481,315 | B1 * | 11/2002 | Chang et al. | 81/60 |
| 6,845,691 | B2 * | 1/2005 | Hsien | 81/60 |
| 6,862,955 | B1 * | 3/2005 | Shu-Sui et al. | 81/60 |
| 7,000,504 | B2 * | 2/2006 | Chen | 81/60 |
| 7,062,994 | B2 * | 6/2006 | Chen | 81/63 |
| 7,111,527 | B1 * | 9/2006 | Lee | 81/63.1 |
| 2007/0277652 | A1 * | 12/2007 | Tuan-Mu | 81/63 |

* cited by examiner

*Primary Examiner* — Monica Carter
*Assistant Examiner* — Danny Hong

(57) ABSTRACT

A socket wrench with a positioning device contains: a body including an accommodating cavity, a first face, and a second face. A toothed holder is accommodated in the accommodating cavity and has a polygonal groove, a first circular portion, a second circular portion, and a ratchet protrusion between the first circular portion and the second circular portion. The first circular portion is inserted to the first face, the second circular portion is inserted to the second face, and the ratchet protrusion engages with a ratchet device. A positioning device includes at least one retaining element disposed on the first circular portion and horizontally moving in the polygonal groove. The first circular portion has a resilient element and a pressing loop which are fitted on the first circular, and the pressing loop has a recess defined on an inner face thereof to correspond to the at least one retaining element.

10 Claims, 18 Drawing Sheets

SOCKET WRENCH WITH POSITIONING DEVICE

FIELD OF THE INVENTION

The present invention relates to a socket wrench with a positioning device which fits with a socket tool securely and replaces the socket tool easily.

BACKGROUND OF THE INVENTION

Referring to FIGS. 1 and 2, a conventional socket wrench 10 contains a toothed holder 11 accommodated on one end thereof, and the toothed holder 11 includes a polygonal groove 111 defined therein, the polygonal groove 11 of the toothed holder 11 has a slot 112 arranged therein to retain a C-ring 12. Furthermore, a socket tool 20 has a hexagonal fitting segment 201, and the hexagonal fitting segment 201 has a plurality of notches 202 formed on plural corners thereof, such that when the hexagonal fitting segment 201 of the socket tool 20 fits with the polygonal groove 111 of the toothed holder 11, the C-ring 12 retains with the plurality of notches 202 of the socket tool 20, thus avoiding the socket tool 20 removing from the polygonal groove 111 of the toothed holder 11.

However, the C-ring 12 cannot retain with the plurality of notches 202 of the socket tool 20 fixedly, and the socket tool 20 removes from the socket wrench 10 easily.

The present invention has arisen to mitigate and/or obviate the afore-described disadvantages.

SUMMARY OF THE INVENTION

The primary objective of the present invention is to provide a socket wrench with a positioning device which fits with a socket tool securely.

Another objective of the present invention is to provide a socket wrench with a positioning device which replaces the socket tool easily.

To obtain the above objectives, a socket wrench with a positioning device provided by the present invention contains: a body including an accommodating cavity defined in at least one end thereof, a first face, and a second face.

A toothed holder is accommodated in the accommodating cavity of the body and has a polygonal groove defined therein, a first circular portion and a second circular portion which are arranged around a peripheral side of the toothed holder, and a ratchet protrusion defined between the first circular portion and the second circular portion, the first circular portion is inserted to the first face of the body, the second circular portion is inserted to the second face of the body, and the ratchet protrusion engages with a ratchet device.

A positioning device includes at least one retaining element disposed on the first circular portion of the toothed holder and horizontally moving in the polygonal groove, wherein the first circular portion of the toothed holder has a resilient element and a pressing loop which are fitted on the first circular, and the pressing loop has a recess defined on an inner face thereof to correspond to the at least one retaining element.

DETAILED DESCRIPTION OF THE PREFERRED EMBODIMENTS

Figure 1:
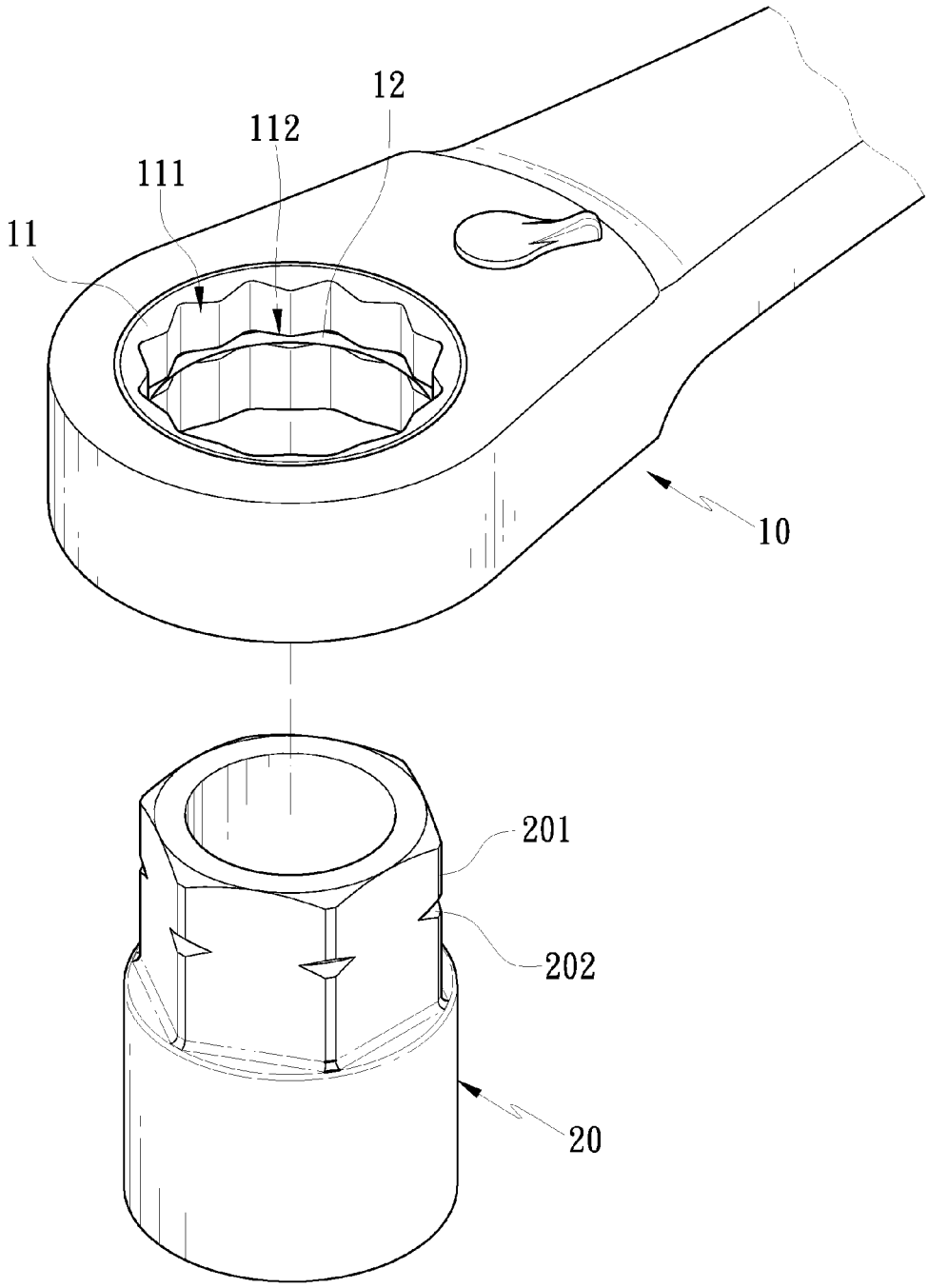
FIG. 1 PRIOR ART
FIG. 1 is a perspective view of a conventional socket wrench and a socket tool.
Figure 2:
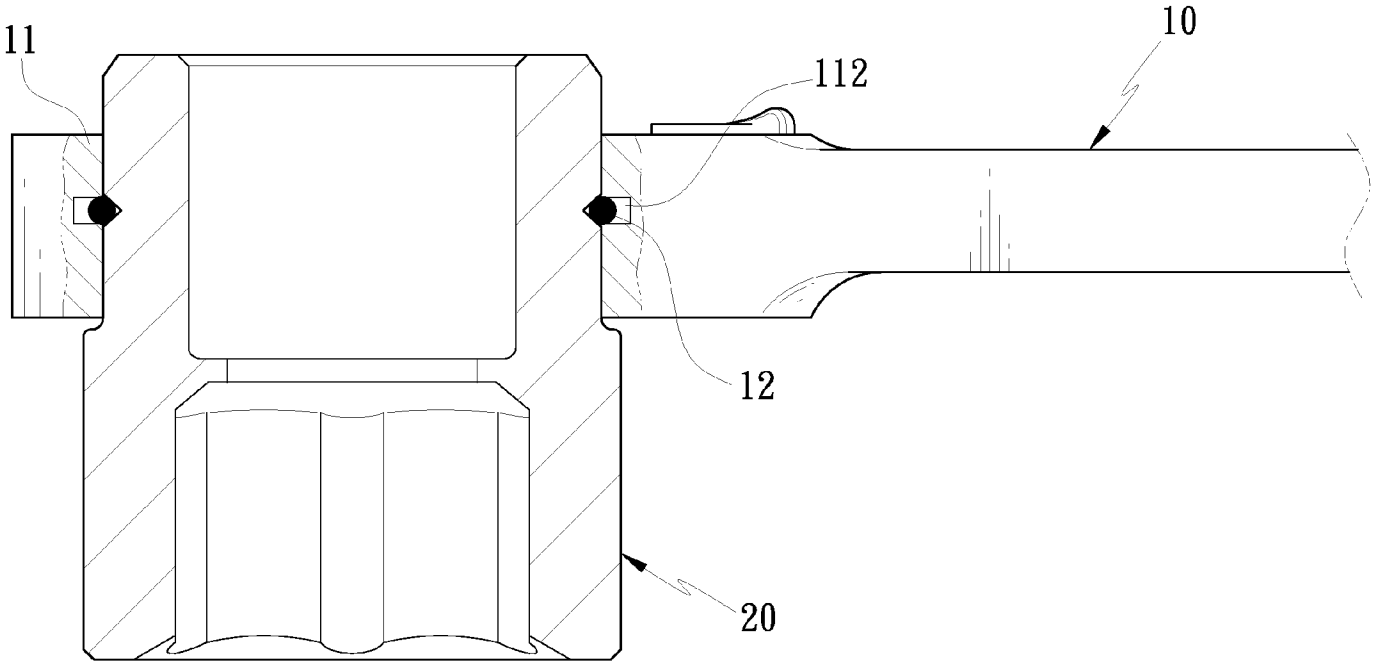
FIG. 2 PRIOR ART
FIG. 2 is a cross sectional view showing the operation of the conventional socket wrench and the socket tool.
Figure 3:
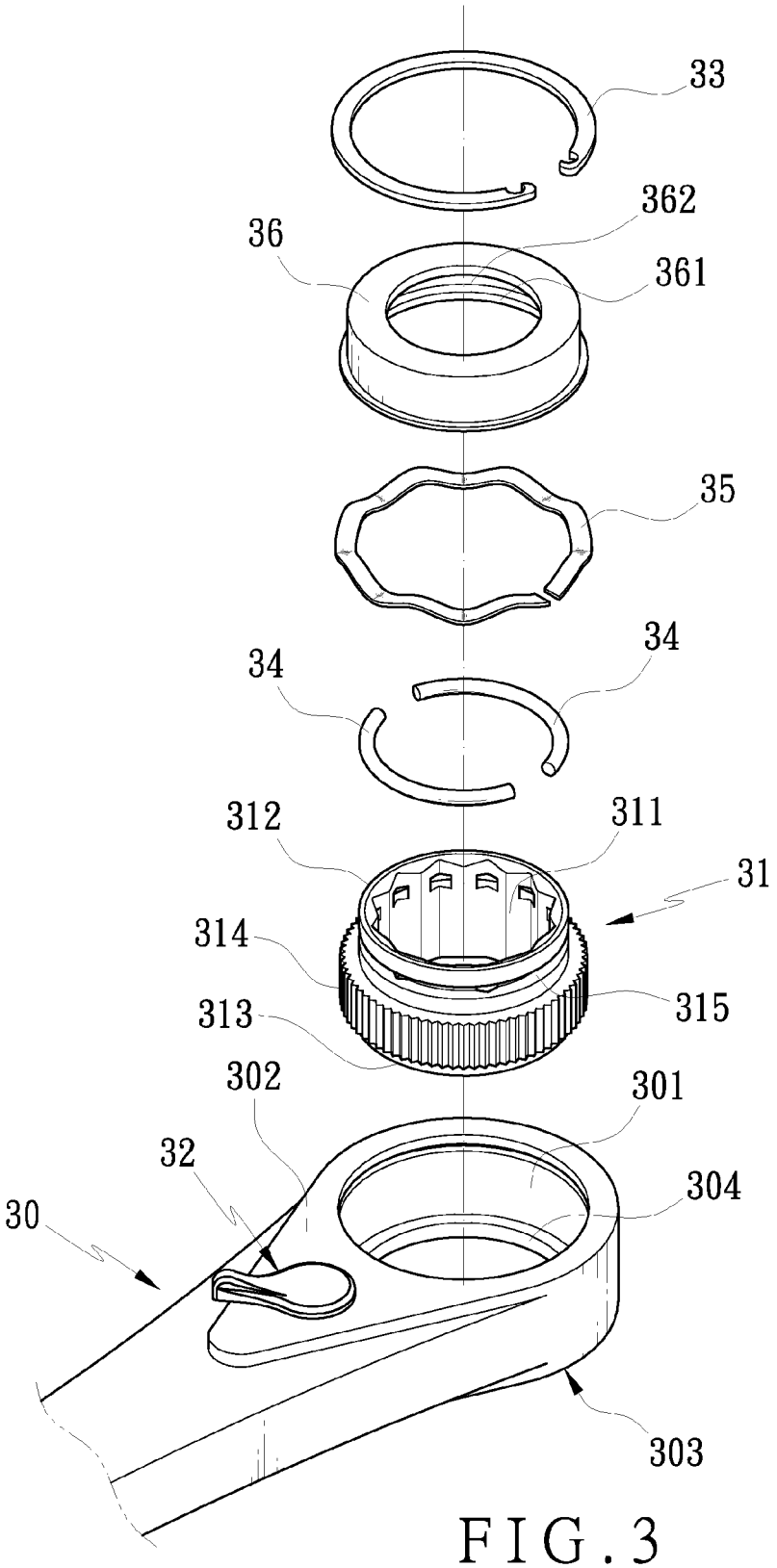
FIG. 3 is a perspective view showing the exploded components of a socket wrench with a positioning device according to a first embodiment of the present invention.
Figure 4:
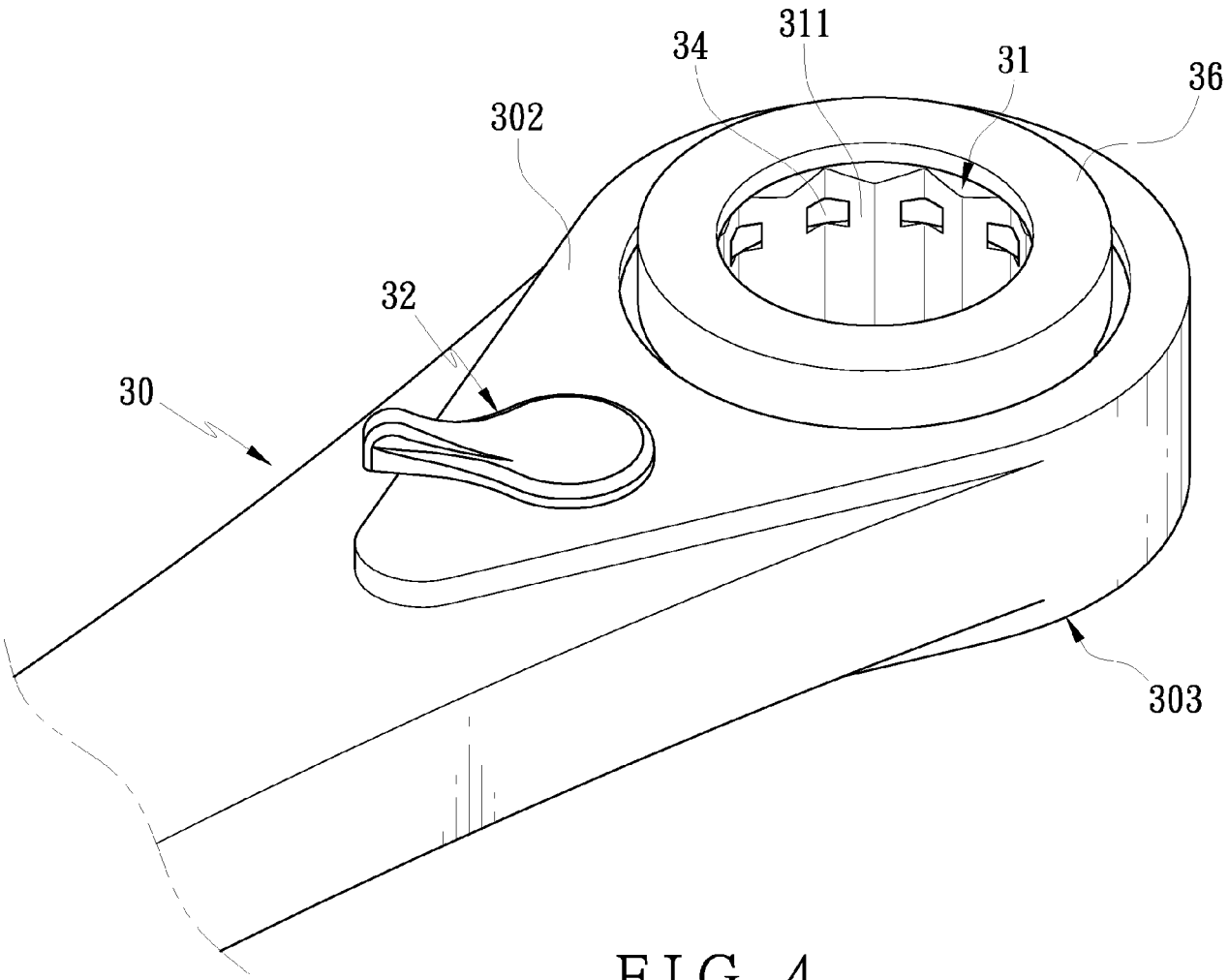
FIG. 4 is a perspective view showing the assembly of the socket wrench with the positioning device according to the first embodiment of the present invention.
Figure 5:
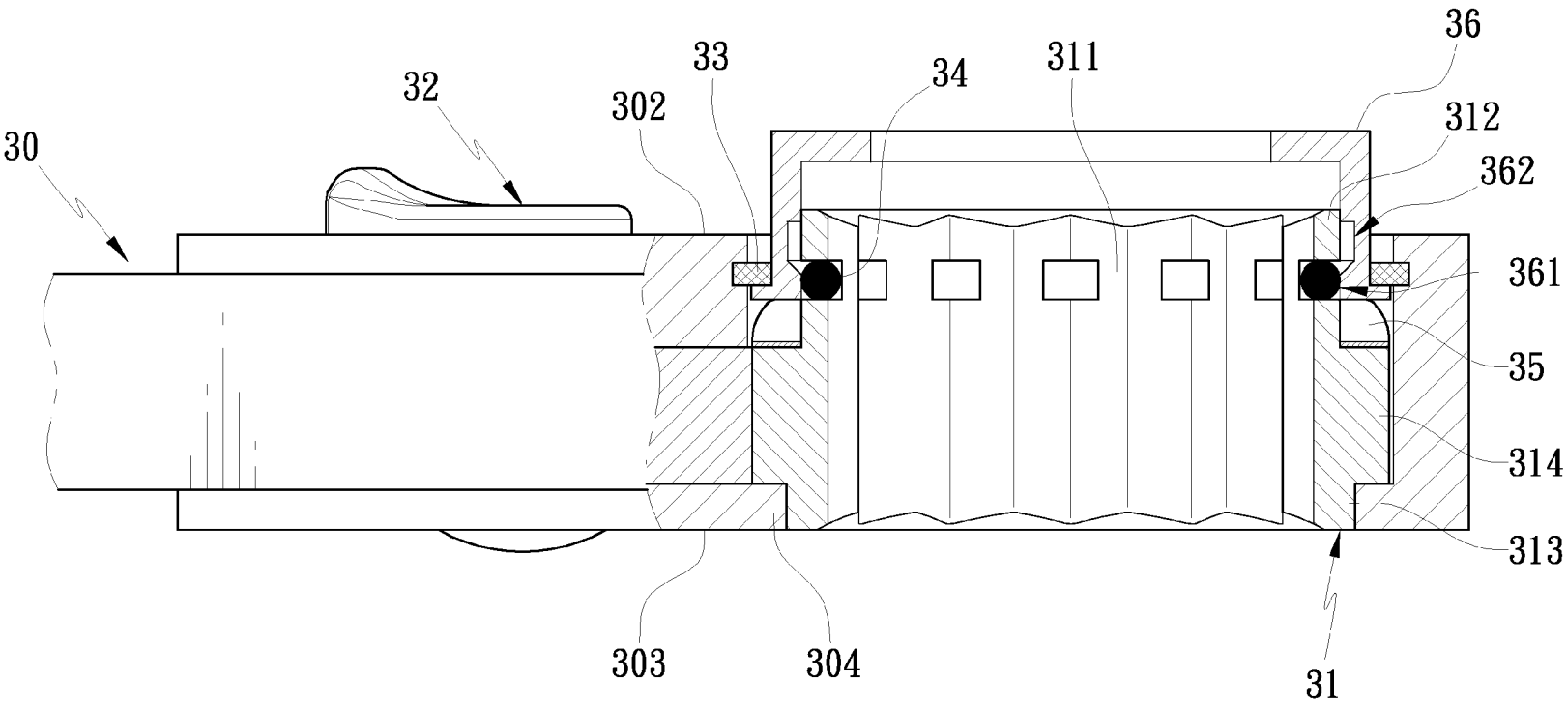
FIG. 5 is a cross sectional view showing the assembly of a part of the socket wrench with the positioning device according to the first embodiment of the present invention.

With reference to FIGS. 3 to 5, a socket wrench according to a first embodiment of the present invention comprises: a body 30, and the body 30 includes an accommodating cavity 301 defined in at least one end thereof, a first face 302, and a second face 303. The accommodating cavity 301 has a first limiting element formed on the first face 302 or the second face 303 of the body 30. In this embodiment, the first limiting element is a stepped shoulder 304 formed on the second face 303 of the body 30. The accommodating cavity 301 has a toothed holder 31 accommodated therein, and the toothed holder 31 has a polygonal groove 311 defined therein to fit with a socket tool, a first circular portion 312 and a second circular portion 313 which are arranged around a peripheral side of the toothed holder 31, and a ratchet protrusion 314 defined between the first circular portion 312 and the second circular portion 313. The first circular portion 312 of the toothed holder 31 is inserted to the first face 302 of the body 30, the second circular portion 313 of the toothed holder 31 is inserted to the stepped shoulder 304 of the accommodating cavity 301, wherein an outer diameter of the ratchet protrusion 314 is larger than that of each of the first circular portion 312 and the second circular portion 313, such that a first end of the ratchet protrusion 314 is limited by the stepped shoulder 304. A second end of the ratchet protrusion 314 is a second limiting element; in this embodiment, and the ratchet protrusion 314 engages with a ratchet device 32 on the body 30 adjacent to the accommodating cavity 301, such that the ratchet device 32 drives the toothed holder 31 to rotate in the accommodating cavity 301 of the body 30. Due to the ratchet device 32 is a well-known art, further remarks are omitted.

A positioning device of the socket wrench according to the first embodiment of the present invention includes at least one retaining element 34 disposed on the first circular portion 312 of the toothed holder 31 and horizontally moving in the polygonal groove 311, wherein the at least one retaining element 34 is a ball or a second C-ring; in this embodiment, the at least one retaining element is two second C-rings. The first circular portion 312 of the toothed holder 31 has a slot 315 defined thereon and not completely communicating with the polygonal groove 311 to accommodate the at least one retaining element 34, and the at least one retaining element 34 partially extends out of or removes from the polygonal groove 311. In this embodiment, a corner of the slot 315 passes through the polygonal groove 311. Furthermore, the first circular portion 312 of the toothed holder 31 has a resilient element 35 and a pressing loop 36 which are fitted on the first circular portion 312, wherein a first end of the resilient element 35 abuts against the second end of the ratchet protrusion 314, and a second end of the resilient element 35 is biased against the pressing loop 36, the pressing loop 36 is positioned by the first C-ring 33 to limit the toothed holder 31 in the accommodating cavity 301, such that when the pressing loop 36 is pressed, it presses the resilient element 35 along an outer surface of the first circular portion 312 and moves toward the second face 303 of the body 30, wherein an inner face 361 of the pressing loop 36 is fitted on the outer surface of the first circular portion 312, and the inner face 361 presses the at least one retaining element 34 so that the at least one retaining element 34 partially extends out of the polygonal groove 311. The pressing loop 36 also has a recess 362 defined on the inner face 361 to correspond to the at least one retaining element 34 and to accommodate the at least one retaining element 34, when the at least one retaining element 34 removes from the polygonal groove 311.

Figure 6:
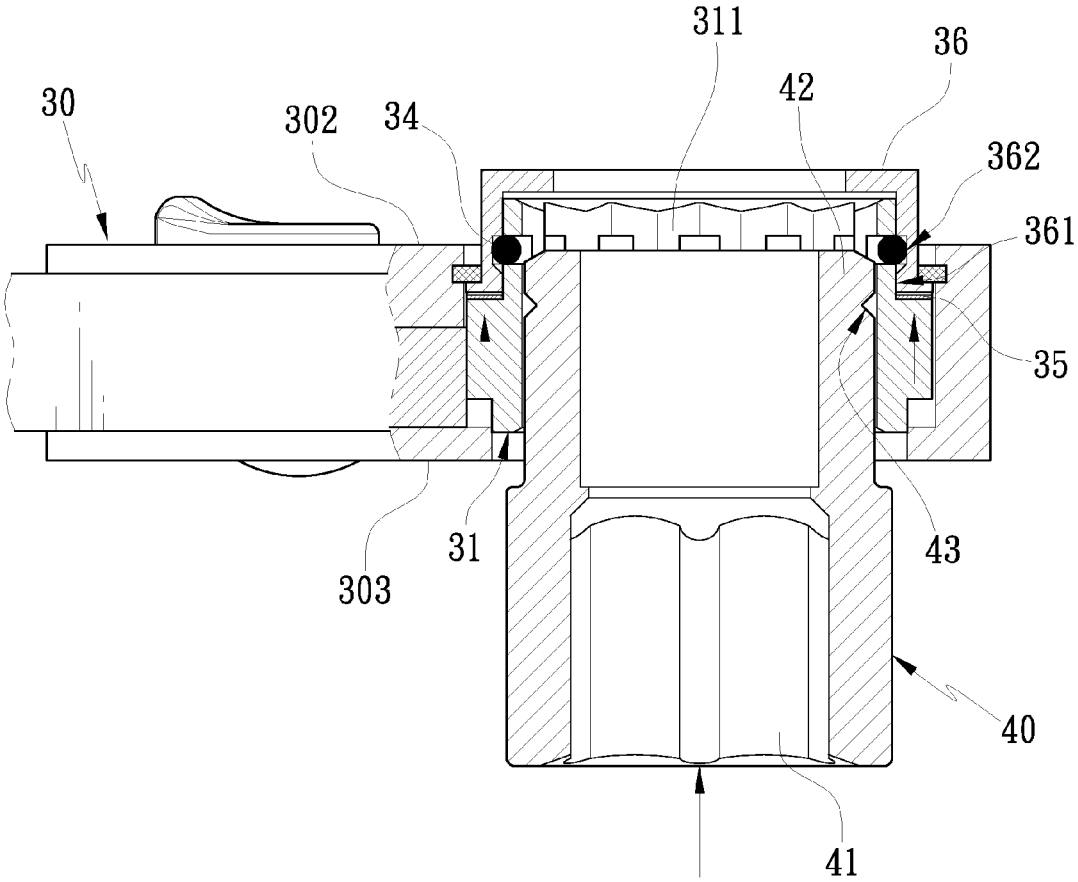
FIG. 6 is a cross sectional view showing the operation of the socket wrench with the positioning device according to the first embodiment of the present invention.

Referring to FIG. 6, the socket tool 40 includes a working segment 41 and a fitting segment 42, wherein the working segment 41 is applied to fix or remove a bolt element, and the fitting segment 42 is hexagonal and is fitted in the polygonal groove 311 of the toothed holder 31, wherein the fitting segment 42 has a notch 43 formed on a predetermined position thereof to match with the at least one retaining element 34. When the polygonal groove 311 of the toothed holder 31 fits with the socket tool 40, the toothed holder 31 presses the socket tool 40, and since the at least one retaining element 34 is pressed by the inner face 361 of the pressing loop 36 to partially extend out of the polygonal groove 311, when the fitting segment 42 of the socket tool 40 pushes the at least one retaining element 34, the at least one retaining element 34 drives the toothed holder 31 to press the resilient element 35, and then the resilient element 35 moves toward the first face 302 of the body 30.

Figure 7:
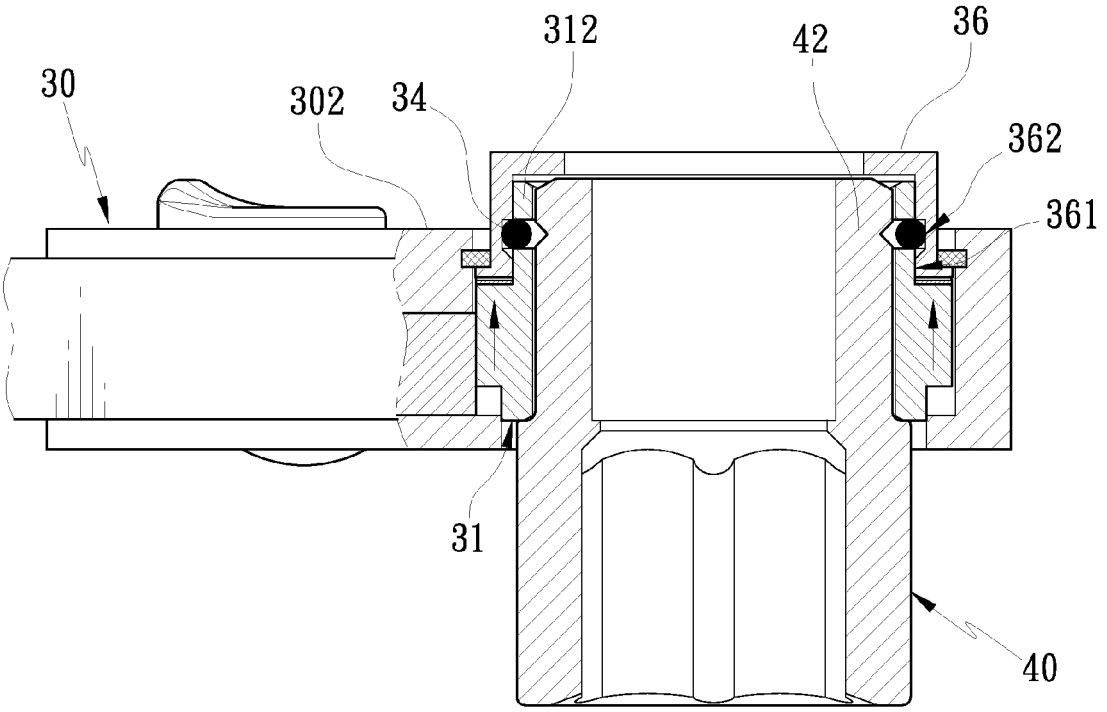
FIG. 7 is another cross sectional view showing the operation of the socket wrench with the positioning device according to the first embodiment of the present invention.

As shown in FIG. 7, when the toothed holder 31 keeps moving toward the first face 302 of the body 30 and the at least one retaining element 34 of the first circular portion 312 corresponds to the recess 362 of the pressing loop 36, the fitting segment 42 of the socket tool 40 drives the at least one retaining element 34 to horizontally move into the recess 362, such that the at least one retaining element 34 removes from the polygonal groove 311, and then the fitting segment 42 of the socket tool 40 fits into the polygonal groove 311 of the toothed holder 31.

Figure 8:
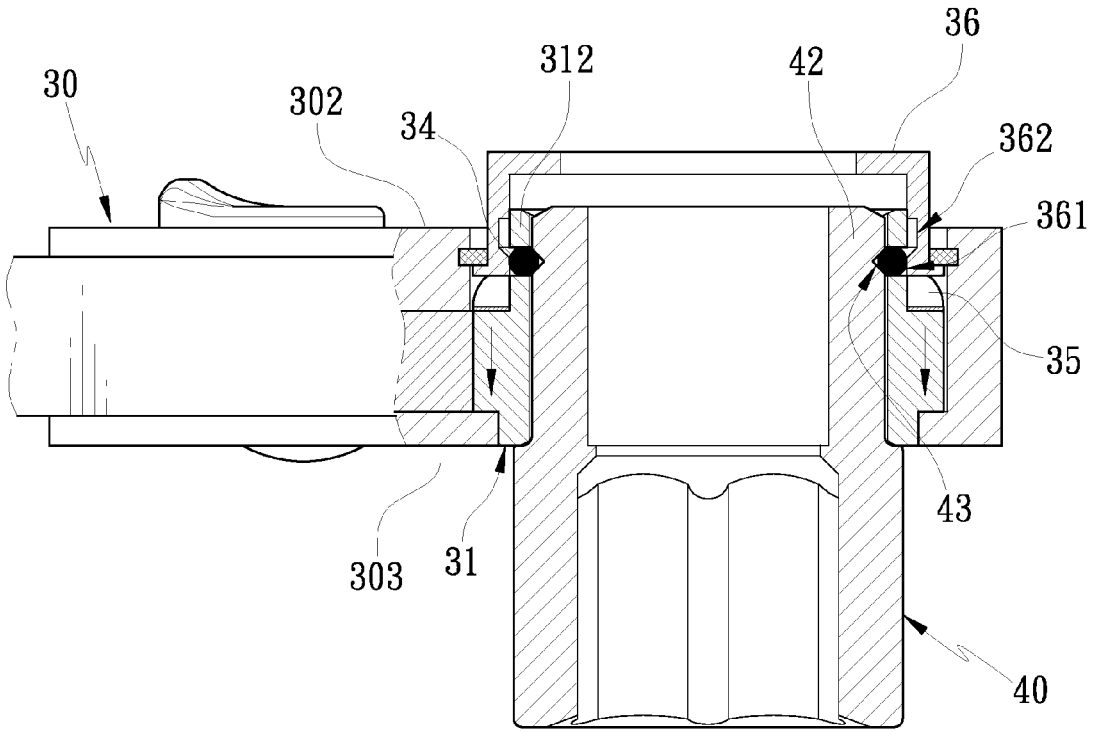
FIG. 8 is also another cross sectional view showing the operation of the socket wrench with the positioning device according to the first embodiment of the present invention.

As illustrated in FIG. 8, after the fitting segment 42 of the socket tool 40 fits into the polygonal groove 311, a user stops exerting force on the socket tool 40 so that the toothed holder 31 moves toward the second face 303 of the body 30 by ways of the resilient element 35, and the at least one retaining element 34 of the first circular portion 312 corresponds to the inner face 361 of the pressing loop 36 so that the at least one retaining element 34 partially extends out of the polygonal groove 311 and retains in the notch 43 of the socket tool 40. Thereby, the at least one retaining element 34 of the positioning device is pushed by the inner face 361 of the pressing loop 36 to prevent a removal of the socket tool 40 from the polygonal groove 311.

Figure 9:
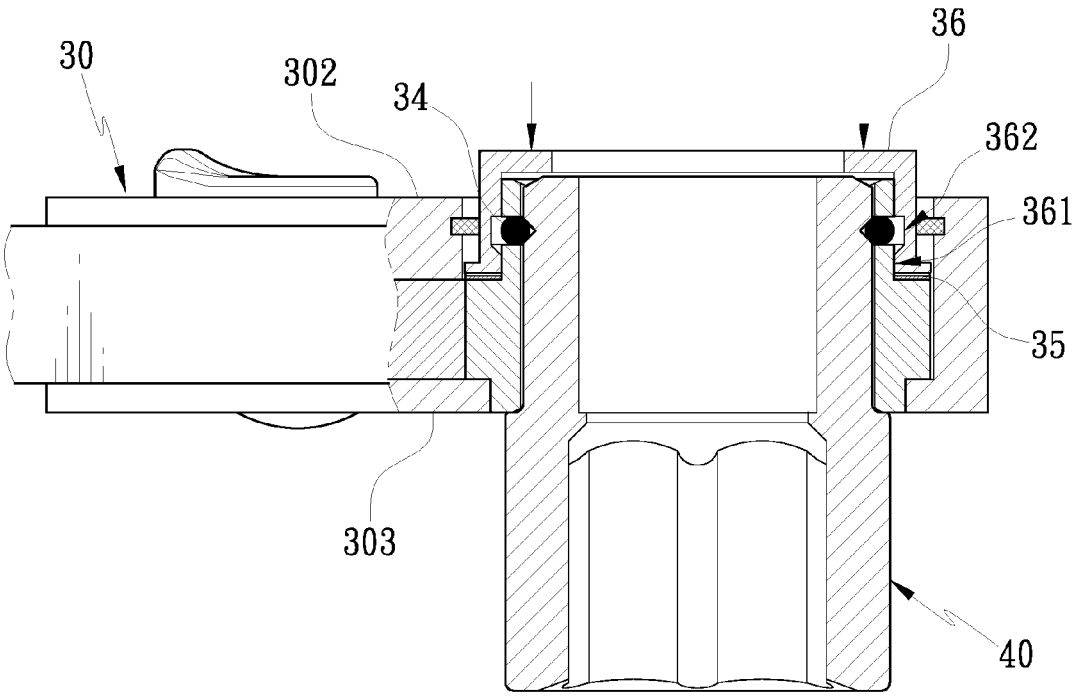
FIG. 9 is still another cross sectional view showing the operation of the socket wrench with the positioning device according to the first embodiment of the present invention.

With reference to FIG. 9, as desiring to replace the socket tool 40, the pressing loop 36 is pressed to abut against the resilient element 35, and then the resilient element 35 moves toward the second face 303 of the body 30 so that the recess 362 of the pressing loop 36 corresponds to the at least one retaining element 34, hence the at least one retaining element 34 moves into the recess 362 from the polygonal groove 311.

Figure 10:
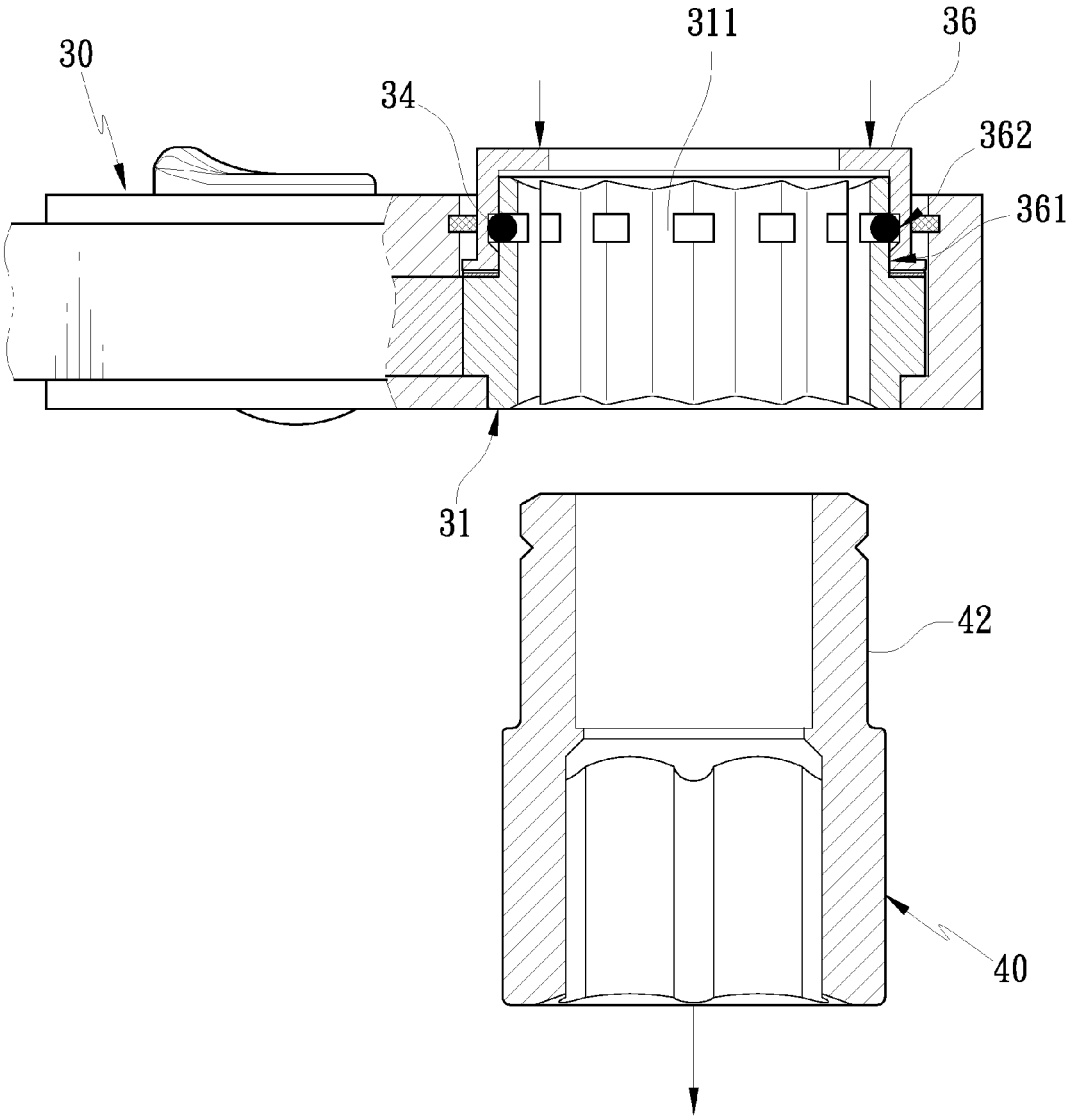
FIG. 10 is another cross sectional view showing the operation of the socket wrench with the positioning device according to the first embodiment of the present invention.

Referring to FIG. 10, when the fitting segment 42 of the socket tool 40 removes from the polygonal groove 311 of the toothed holder 31, the fitting segment 42 of the socket tool 40 pushes the at least one retaining element 34 to horizontally move toward the recess 362 from the polygonal groove 311, such that the fitting segment 42 of the socket tool 40 is removed from the polygonal groove 311 of the toothed holder 31, and then the socket tool 40 removes from the toothed holder 31, thus replacing the socket tool 40 easily.

Figure 11:
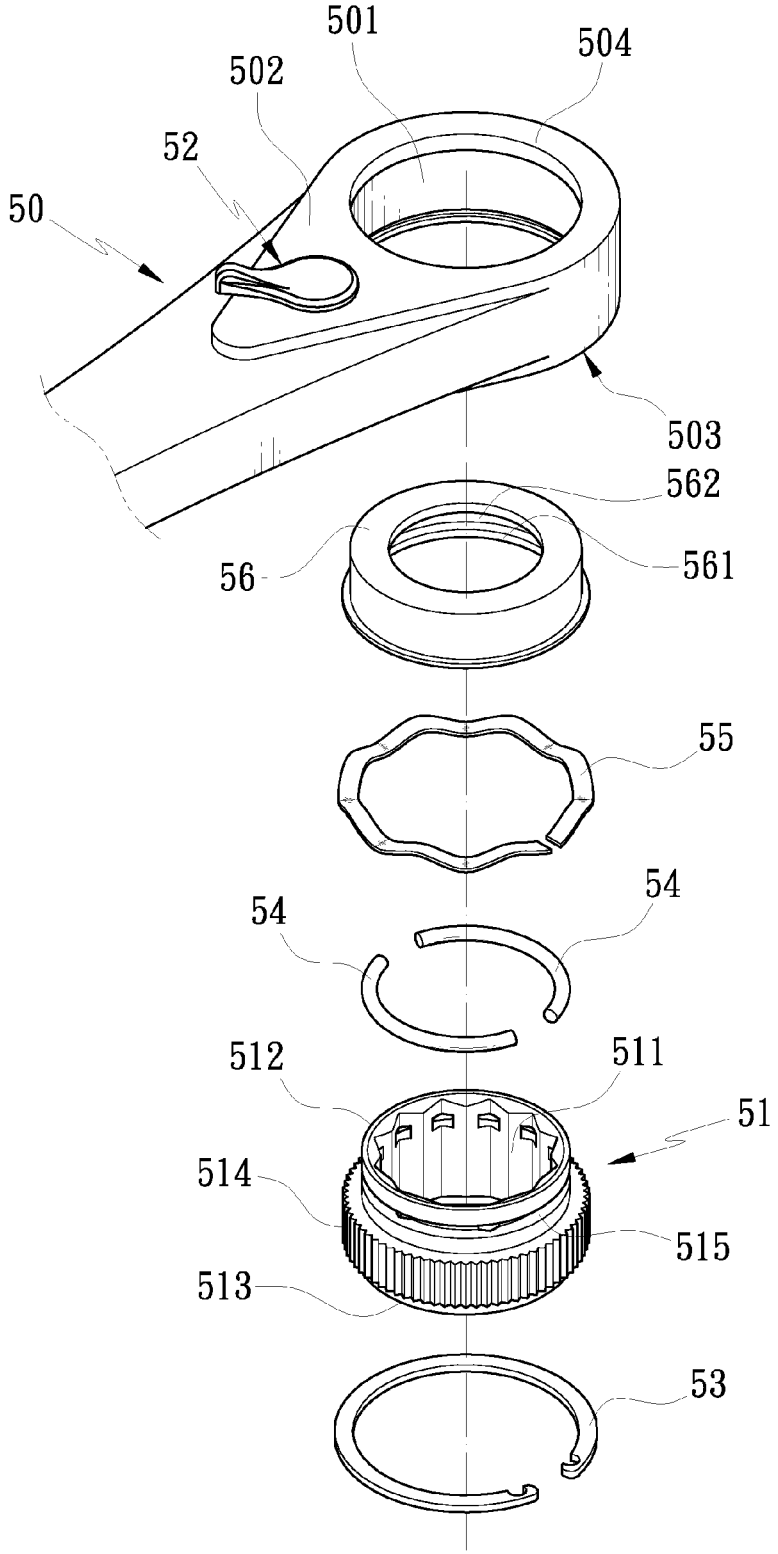
FIG. 11 is a perspective view showing the exploded components of a socket wrench with a positioning device according to a second embodiment of the present invention.
Figure 12:
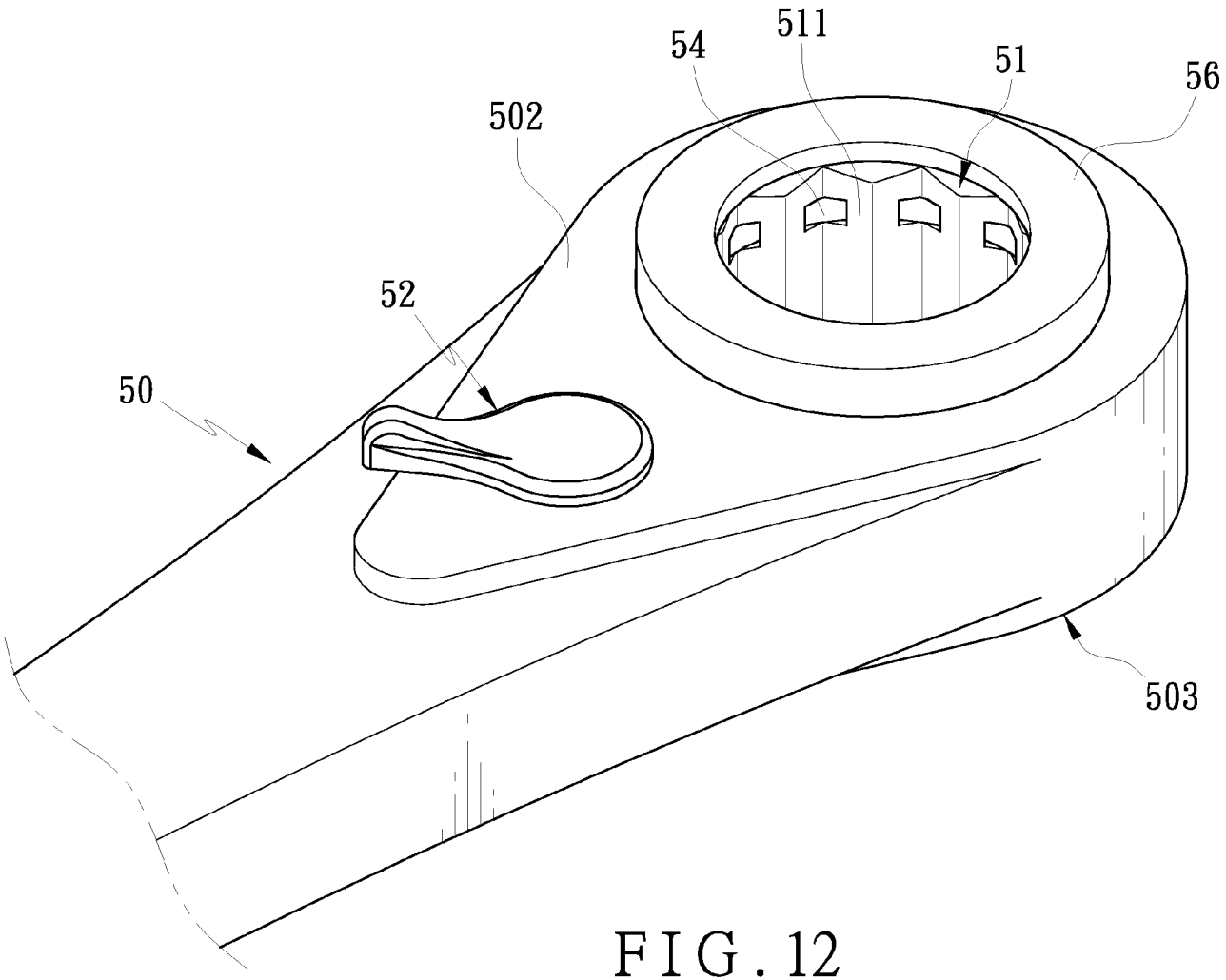
FIG. 12 is a perspective view showing the assembly of the socket wrench with the positioning device according to the second embodiment of the present invention.
Figure 13:
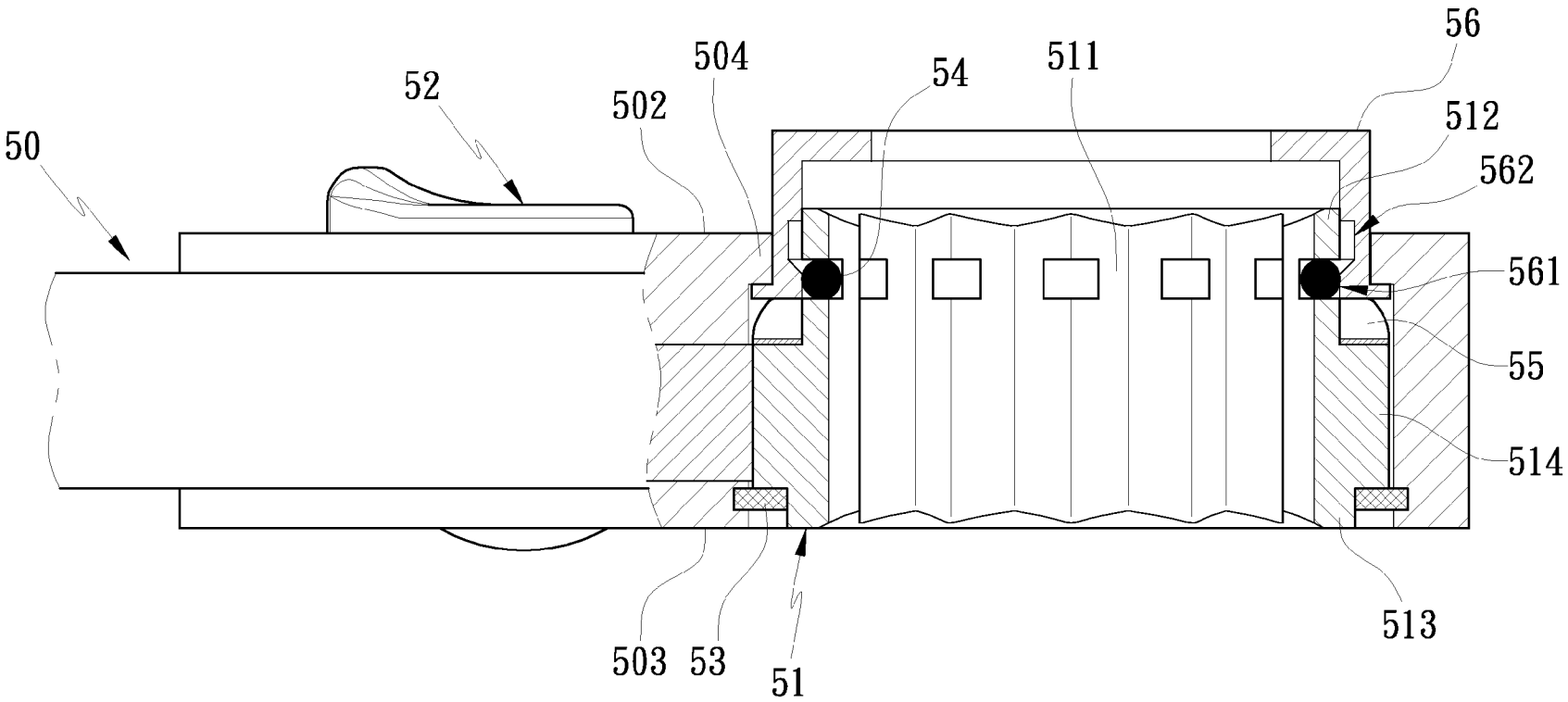
FIG. 13 is a cross sectional view showing the assembly of a part of the socket wrench with the positioning device according to the second embodiment of the present invention.

As shown in FIGS. 11 to 13, a socket wrench according to a second embodiment of the present invention comprises: a body 50, and the body 50 includes an accommodating cavity 501 defined in at least one end thereof, a first face 502, and a second face 503. The accommodating cavity 501 has a first limiting element formed on the first face 502 or the second face 503 of the body 50. In this embodiment, the first limiting element is a stepped shoulder 504 formed on the first face 502 of the body 50. The accommodating cavity 501 has a toothed holder 51 accommodated therein, and the toothed holder 51 has a polygonal groove 511 defined therein to fit with the socket tool, a first circular portion 512 and a second circular portion 513 which are arranged around a peripheral side of the toothed holder 51, and a ratchet protrusion 514 defined between the first circular portion 512 and the second circular portion 513. The first circular portion 512 of the toothed holder 51 is inserted to the stepped shoulder 504 of the accommodating cavity 501, the second circular portion 513 of the toothed holder 51 is inserted to the second face 503 of the body 50, wherein an outer diameter of the ratchet protrusion 514 is larger than that of each of the first circular portion 512 and the second circular portion 513, such that a first end of the ratchet protrusion 514 is limited by a second limiting element, such that the toothed holder 51 is fixed in the accommodating cavity 501. In this embodiment, the second limiting element is a first C-ring 53, and the ratchet protrusion 514 engages with a ratchet device 52 on the body 50 adjacent to the accommodating cavity 501, such that the ratchet device 52 drives the toothed holder 51 to rotate in the accommodating cavity 501 of the body 50. Because the ratchet device 52 is a well-known art, further remarks are omitted.

A positioning device of the socket wrench according to the second embodiment of the present invention includes at least one retaining element 54 disposed on the first circular portion 512 of the toothed holder 51 and horizontally moving in the polygonal groove 511, wherein the at least one retaining element 54 is a ball or a second C-ring; in this embodiment, the at least one retaining element is two second C-rings. The first circular portion 512 of the toothed holder 51 has a slot 515 defined thereon and not completely communicating with the polygonal groove 511 to accommodate the at least one retaining element 54, and the at least one retaining element 54 partially extends out of or removes from the polygonal groove 511. In this embodiment, a corner of the slot 515 passes through the polygonal groove 511. Furthermore, the first circular portion 512 of the toothed holder 51 has a resilient element 55 and a pressing loop 56 which are fitted on the first circular portion 512, wherein a first end of the resilient element 55 abuts against the second end of the ratchet protrusion 514, and a second end of the resilient element 55 is biased against the pressing loop 56, the pressing loop 56 abuts against the stepped shoulder 504, such that when the pressing loop 56 is pressed, it presses the resilient element 55 along an outer surface of the first circular portion 512 and moves toward the second face 503 of the body 50, wherein an inner face 561 of the pressing loop 56 is fitted on the outer surface of the first circular portion 512, and the inner face 561 presses the at least one retaining element 54 so that the at least one retaining element 54 partially extends out of the polygonal groove 511. The pressing loop 56 also has a recess 562 defined on the inner face 561 to correspond to the at least one retaining element 54 and to accommodate the at least one retaining element 54, when the at least one retaining element 54 removes from the polygonal groove 511.

Figure 14:
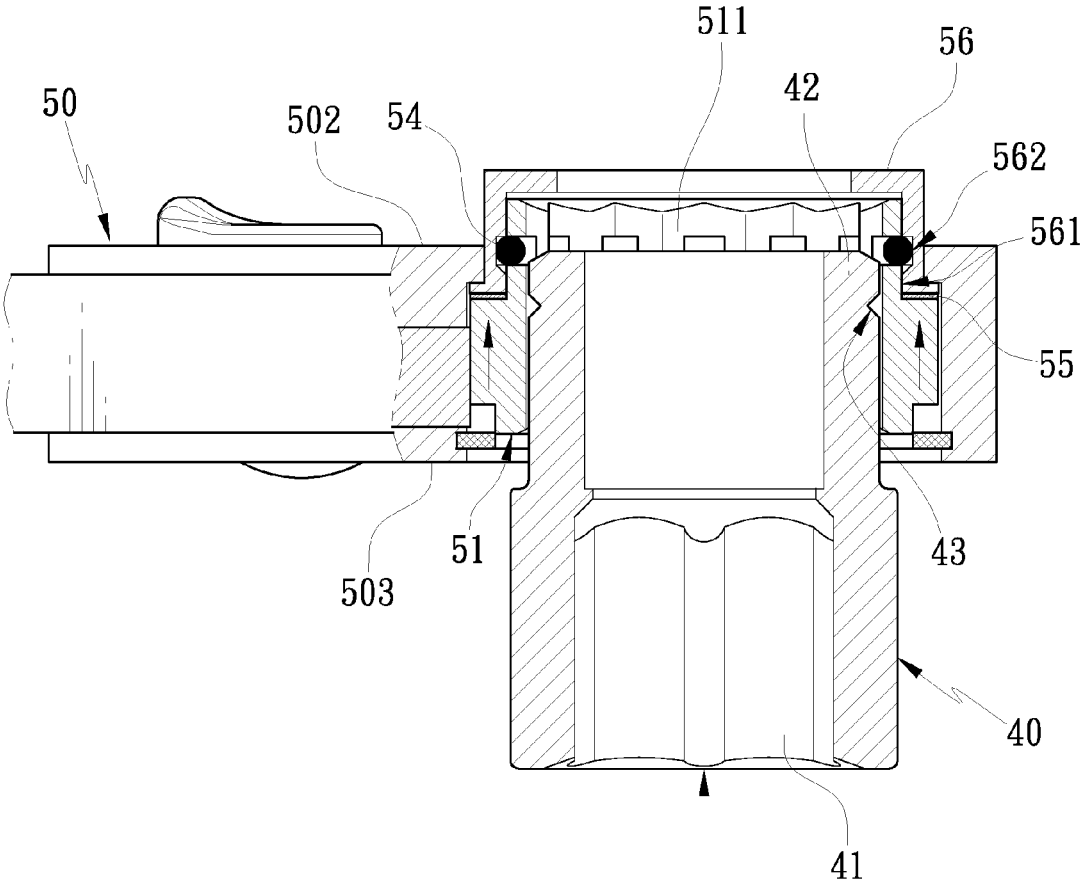
FIG. 14 is a cross sectional view showing the operation of the socket wrench with the positioning device according to the second embodiment of the present invention.

Referring to FIG. 14, the socket tool 40 includes a working segment 41 and a fitting segment 42, wherein the working segment 41 is applied to fix or remove a bolt element, and the fitting segment 42 is hexagonal and is fitted in the polygonal groove 511 of the toothed holder 51, wherein the fitting segment 42 has a notch 43 formed on a predetermined position thereof to match with the at least one retaining element 54. When the polygonal groove 511 of the toothed holder 51 fits with the socket tool 40, the toothed holder 51 presses the socket tool 40, and since the at least one retaining element 54 is pressed by the inner face 561 of the pressing loop 56 to partially extend out of the polygonal groove 511, when the fitting segment 42 of the socket tool 40 pushes the at least one retaining element 54, the at least one retaining element 54 drives the toothed holder 51 to press the resilient element 55, and then the resilient element 55 moves toward the first face 502 of the body 50.

Figure 15:
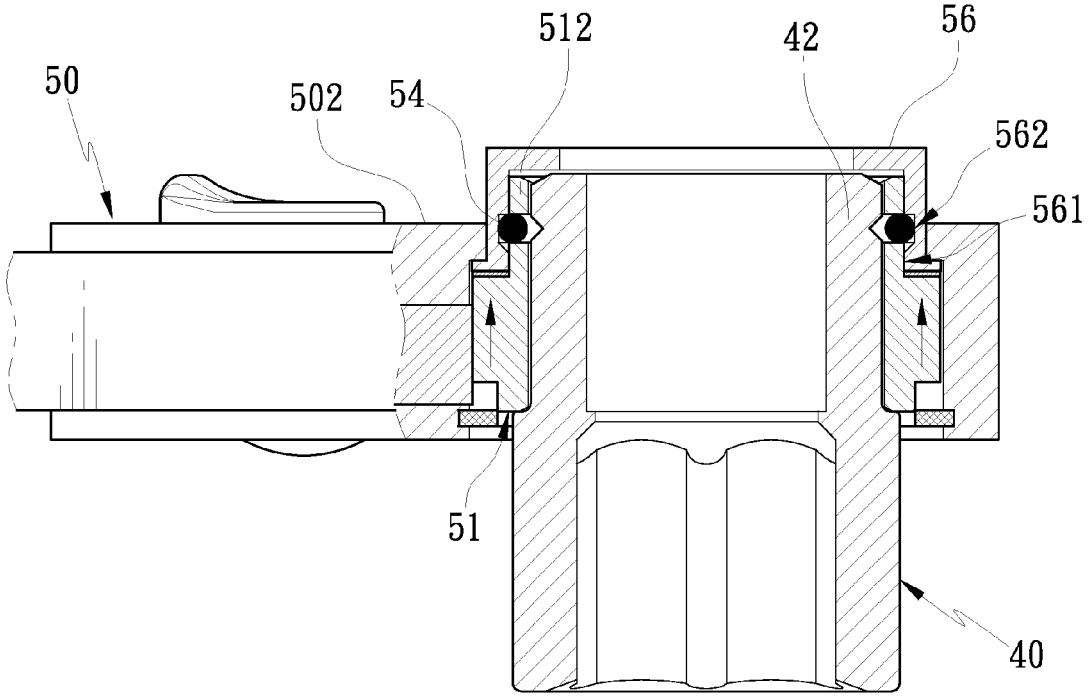
FIG. 15 is another cross sectional view showing the operation of the socket wrench with the positioning device according to the second embodiment of the present invention.

As shown in FIG. 15, when the toothed holder 51 keeps moving toward the first face 502 of the body 50 and the at least one retaining element 54 of the first circular portion 512 corresponds to the recess 562 of the pressing loop 56, the fitting segment 42 of the socket tool 40 drives the at least one retaining element 54 to horizontally move into the recess 562, such that the at least one retaining element 54 removes from the polygonal groove 511, and then the fitting segment 42 of the socket tool 40 fits into the polygonal groove 511 of the toothed holder 51.

Figure 16:
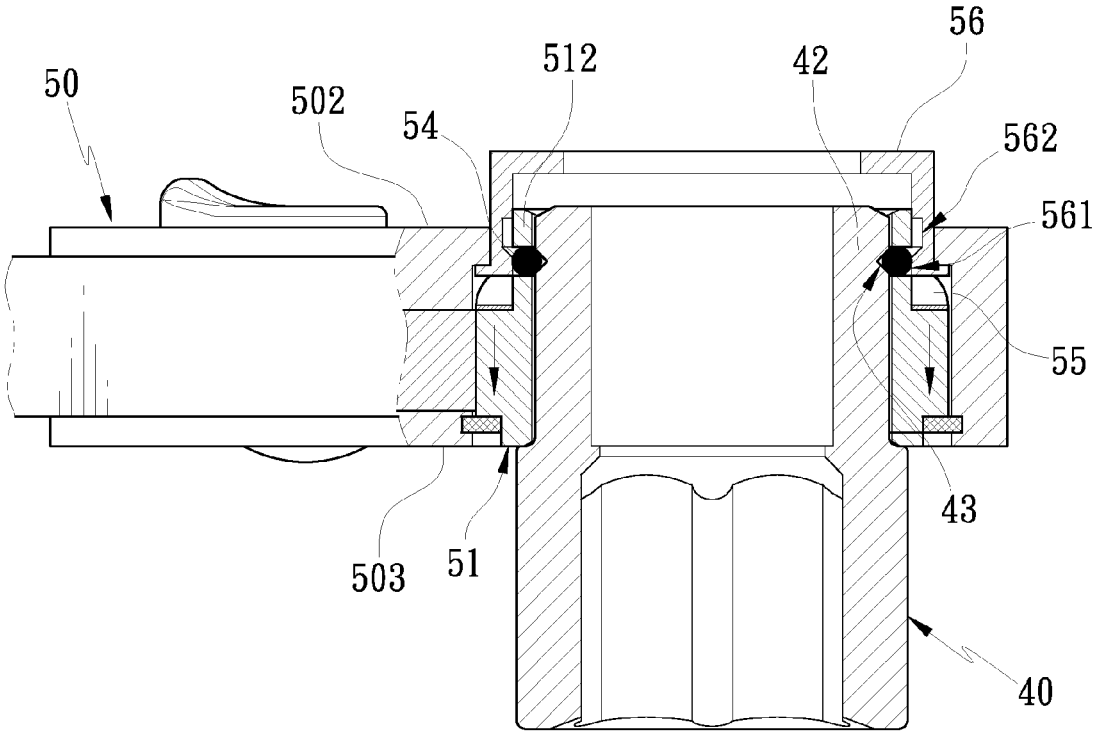
FIG. 16 is also another cross sectional view showing the operation of the socket wrench with the positioning device according to the second embodiment of the present invention.

As illustrated in FIG. 16, after the fitting segment 42 of the socket tool 40 fits into the polygonal groove 511 of the toothed holder 51, a user stops exerting force on the socket tool 40 so that the toothed holder 51 moves toward the second face 503 of the body 50 by ways of the resilient element 55, and the at least one retaining element 54 of the first circular portion 512 corresponds to the inner face 561 of the pressing loop 56 so that the at least one retaining element 54 partially extends out of the polygonal groove 511 and retains in the notch 43 of the socket tool 40. Thereby, the at least one retaining element 54 of the positioning device is pushed by the inner face 561 of the pressing loop 56 to prevent a removal of the socket tool 40 from the polygonal groove 511.

Figure 17:
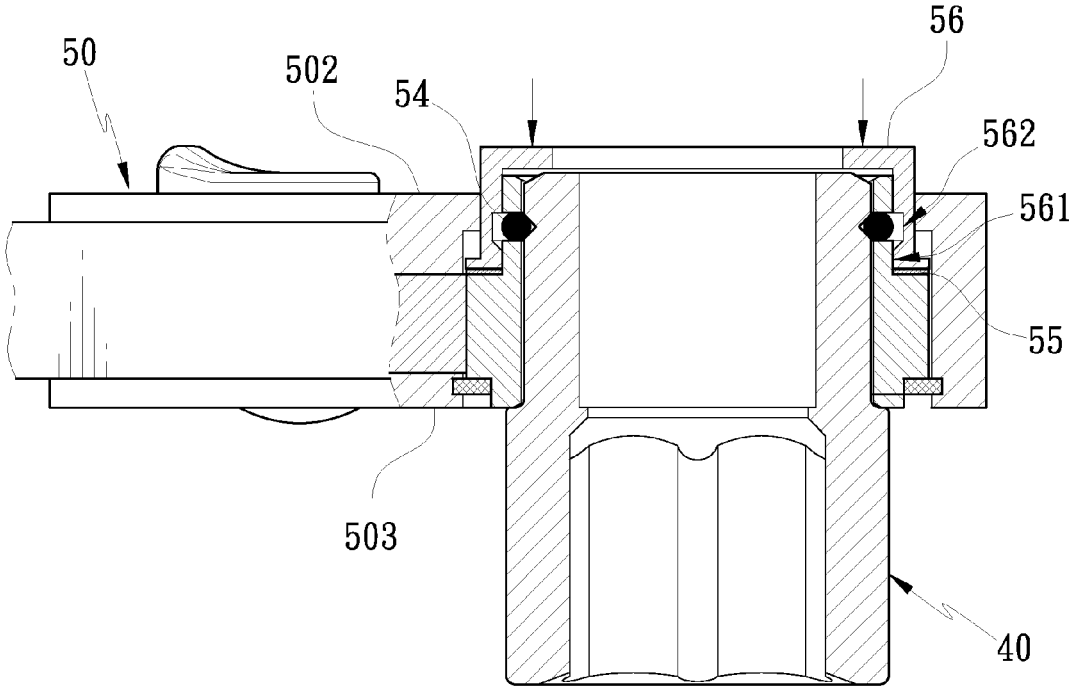
FIG. 17 is still another cross sectional view showing the operation of the socket wrench with the positioning device according to the second embodiment of the present invention.

With reference to FIG. 17, as desiring to replace the socket tool 40, the pressing loop 56 is pressed to abut against the resilient element 55, and then the resilient element 55 moves toward the second face 503 of the body 50 so that the recess 562 of the pressing loop 56 corresponds to the at least one retaining element 54, hence the at least one retaining element 54 moves into the recess 562 from the polygonal groove 511.

Figure 18:
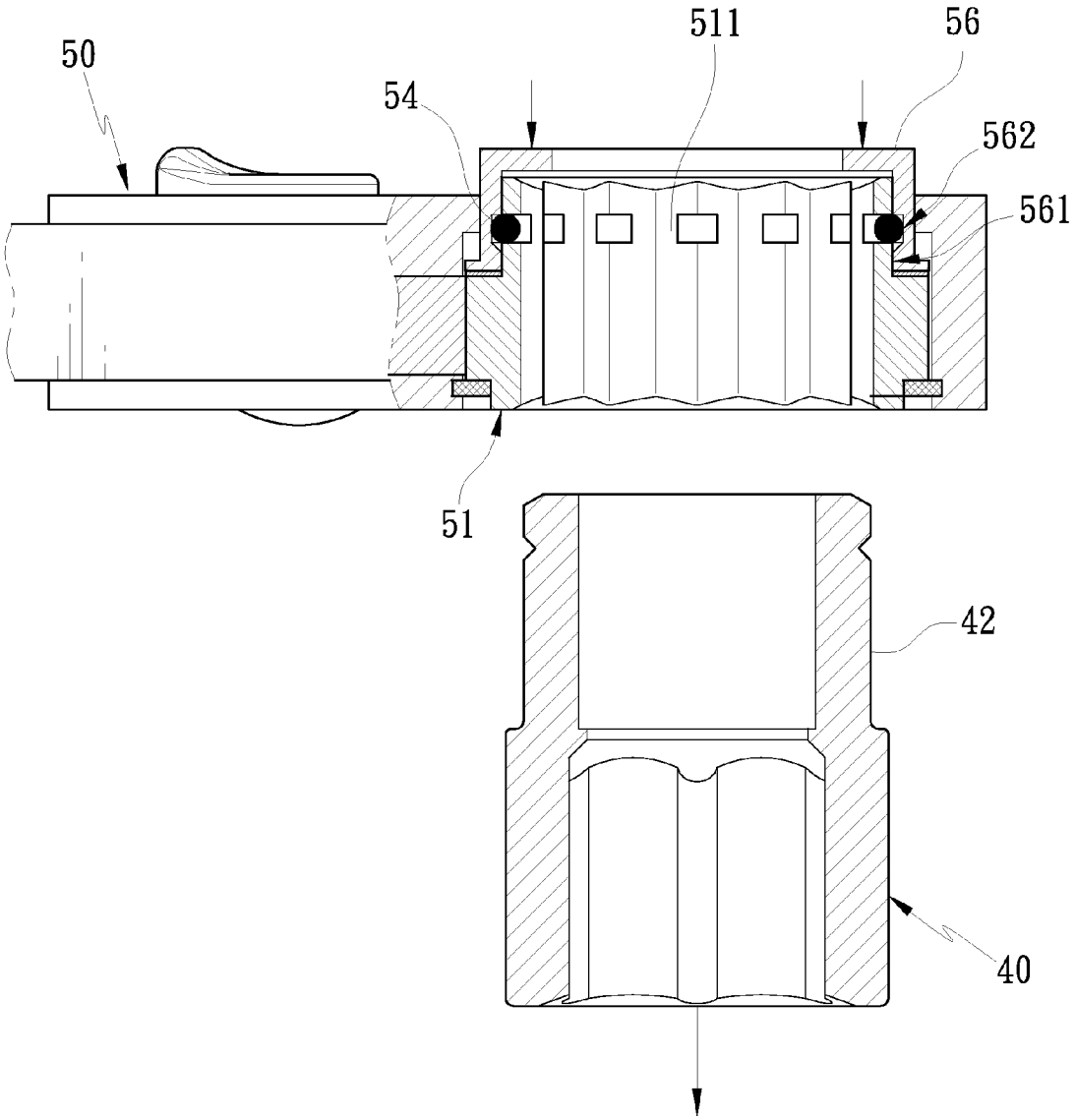
FIG. 18 is another cross sectional view showing the operation of the socket wrench with the positioning device according to the second embodiment of the present invention.

Referring to FIG. 18, when the fitting segment 42 of the socket tool 40 removes from the polygonal groove 511 of the toothed holder 51, the fitting segment 42 of the socket tool 40 pushes the at least one retaining element 54 to horizontally move toward the recess 562 from the polygonal groove 511, such that the fitting segment 42 of the socket tool 40 is removed from the polygonal groove 511 of the toothed holder 51, and then the socket tool 40 removes from the toothed holder 51, thus replacing the socket tool 40 easily.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A socket wrench with a positioning device comprising:

a body including an accommodating cavity defined in at least one end thereof, a first face, and a second face;

a toothed holder accommodated in the accommodating cavity of the body and having a polygonal groove defined therein, a first circular portion and a second circular portion which are arranged around a peripheral side of the toothed holder, and a ratchet protrusion defined between the first circular portion and the second circular portion, the first circular portion being inserted to the first face of the body, the second circular portion being inserted to the second face of the body, and the ratchet protrusion engaging with a ratchet device;

a positioning device including at least one retaining element disposed on the first circular portion of the toothed holder and horizontally moving in the polygonal groove, wherein the first circular portion of the toothed holder has a resilient element and a pressing loop which are fitted on the first circular, and the pressing loop has a recess defined on an inner face thereof to correspond to the at least one retaining element.

2. The socket wrench with the positioning device as claimed in claim 1, wherein the polygonal groove of the toothed holder is employed to fit with a socket tool having a fitting segment and a notch.

3. The socket wrench with the positioning device as claimed in claim 1, wherein the accommodating cavity of the body has a first limiting element formed on the second face of the body, and the first limiting element is a stepped shoulder.

4. The socket wrench with the positioning device as claimed in claim 3, wherein a first end of the ratchet protrusion is limited by the stepped shoulder, and the second circular portion of the toothed holder is inserted to the stepped shoulder.

5. The socket wrench with the positioning device as claimed in claim 4, wherein a first end of the resilient element of the positioning device abuts against a second end of the ratchet protrusion of the toothed holder, and a first end of the resilient element is biased against the pressing loop, the pressing loop is positioned by a second limiting element, and the second limiting element is a first C-ring for limiting the toothed holder in the accommodating cavity of the body.

6. The socket wrench with the positioning device as claimed in claim 1, wherein the accommodating cavity of the body has a first limiting element formed on the first face of the body, and the first limiting element is a stepped shoulder.

7. The socket wrench with the positioning device as claimed in claim 6, wherein a first end of the resilient element of the positioning device abuts against a first end of the ratchet protrusion of the toothed holder, and a second end of the resilient element is biased against the pressing loop, the pressing loop is positioned by the stepped shoulder.

8. The socket wrench with the positioning device as claimed in claim 7, wherein a second end of the ratchet protrusion of the toothed holder is limited by a second limiting element, and the second limiting element is a first C-ring, such that the ratchet protrusion is limited in the accommodating cavity of the body.

9. The socket wrench with the positioning device as claimed in claim 1, wherein the positioning device also includes a slot defined on the first circular portion of the toothed holder and not completely communicating with the polygonal groove to accommodate the at least one retaining element, and the at least one retaining element partially extends out of or removes from the polygonal groove.

10. The socket wrench with the positioning device as claimed in claim 9, wherein the at least one retaining element is a ball or a second C-ring.

* * * * *